US005932401A

United States Patent [19]

Chen

[11] Patent Number: 5,932,401

[45] Date of Patent: Aug. 3, 1999

[54] REVERSAL PHOTOGRAPHIC ELEMENTS COMPRISING AN ADDITIONAL LAYER CONTAINING AN IMAGING EMULSION AND A NON-IMAGING EMULSION

[75] Inventor: Keath T. Chen, Rochester, N.Y.

[73] Assignee: Eastman Kodak Company, Rochester, N.Y.

[21] Appl. No.: 08/916,188

[22] Filed: Aug. 21, 1997

[51] Int. Cl.[6] ..... G03C 1/035; G03C 1/10; G03C 1/46; G03C 1/76

[52] U.S. Cl. ..... 430/504; 430/567; 430/568; 430/523; 430/571; 430/362; 430/957; 430/503; 430/505

[58] Field of Search ..... 430/567, 568, 430/523, 571, 362, 957, 503, 505, 504

[56] References Cited

U.S. PATENT DOCUMENTS

| | | | |
|---|---|---|---|
| 4,082,553 | 4/1978 | Groet | 430/505 |
| 4,400,463 | 8/1983 | Maskasky | 430/434 |
| 4,433,048 | 2/1984 | Solberg et al. | 430/434 |
| 4,434,226 | 2/1984 | Wilgus et al. | 430/567 |
| 4,435,501 | 3/1984 | Maskasky | 430/434 |
| 4,439,520 | 3/1984 | Kofron et al. | 430/434 |
| 4,554,245 | 11/1985 | Hayashi et al. | 430/567 |
| 4,614,707 | 9/1986 | Fujita et al. | 430/379 |
| 4,656,122 | 4/1987 | Sowinski et al. | 430/505 |
| 4,752,558 | 6/1988 | Shimura et al. | 430/505 |
| 5,176,990 | 1/1993 | Kim | 430/569 |
| 5,262,287 | 11/1993 | Deguchi et al. | 430/504 |
| 5,391,468 | 2/1995 | Cohen et al. | 430/503 |
| 5,552,265 | 9/1996 | Bredoux et al. | 430/372 |
| 5,830,628 | 11/1998 | Borst et al. | 430/506 |

FOREIGN PATENT DOCUMENTS

| | | | |
|---|---|---|---|
| 0 442 323 A2 | 8/1991 | European Pat. Off. | G03C 7/32 |
| 34 02 840 | 1/1984 | Germany | G03C 7/26 |
| 3402840 A1 | 1/1984 | Germany | G03C 5/50 |
| 19526470 A1 | 7/1995 | Germany | G03C 7/305 |
| 63-236034 | 9/1988 | Japan | G03C 7/20 |
| 1202110 | 12/1968 | United Kingdom . | |

OTHER PUBLICATIONS

Abstract—JP 63 236034.
Abstract, DE 3402840.
Research Disclosure, vol. 225, Jan. '83, Item 22534.

*Primary Examiner*—Mark F. Huff
*Attorney, Agent, or Firm*—Andrew J. Anderson

[57] ABSTRACT

Silver halide photographic elements which are capable of producing reversal images are disclosed including a substantially non-image forming overcoat or intercoat layer comprising an image forming emulsion and a non-image forming emulsion. The combination of imaging emulsion and nonimaging emulsion in a substantially non-image forming overcoat or intercoat layer results in an increase in interlayer interimage effects.

34 Claims, 1 Drawing Sheet

REVERSAL PHOTOGRAPHIC ELEMENTS COMPRISING AN ADDITIONAL LAYER CONTAINING AN IMAGING EMULSION AND A NON-IMAGING EMULSION

FIELD OF THE INVENTION

This invention relates to improved photographic elements adapted for producing reversal images. More specifically, this invention relates to reversal silver halide photographic elements containing an overcoat or intercoat comprising an imaging emulsion and a non-image forming emulsion.

BACKGROUND OF THE INVENTION

The term "silver haloiodide" is employed in its art recognized usage to designate silver halide grains containing silver ions in combination with iodide ions and at least one of chloride and bromide ions. The term "reversal photographic element" designates a photographic element which produces a photographic image for viewing by being imagewise exposed and developed to produce a negative of the image to be viewed, followed by uniform exposure and/or fogging of residual silver halide and processing to produce a second, viewable image. Color slides, such as those produced from Kodachrome® and Ektachrome® films, constitute a popular example of reversal photographic elements. In the overwhelming majority of applications the first image is negative and the second image is positive. Groet U.S. Pat. No. 4,082,553 illustrates a conventional reversal photographic element containing a silver haloiodide grains modified by the incorporation of a small proportion of fogged silver halide grains. Hayashi et al German OLS No. 3,402,840 is similar to Groet, but describes the imaging silver halide grains in terms of those larger than and smaller than 0.3 micrometer and additionally requires in addition to the fogged silver halide grains or their metal or metal sulfide equivalent an organic compound capable of forming a silver salt of low solubility.

High aspect ratio tabular grain silver haloiodide emulsions have been recognized to provide a variety of photographic advantages, such as improvements in speed-granularity relationships, increased image sharpness, and reduced blue speed of minus blue recording emulsion layers. High aspect ratio tabular grain silver haloiodide emulsions in reversal photographic elements are illustrated by Research Disclosure Vol. 225, January 1983, Item 22534; Wilgus et al U.S. Pat. No. 4,434,226; Kofron et al U.S. Pat. No. 4,439,520; Solberg et al U.S. Pat. No. 4,433,048; Maskasky U.S. Pat. No. 4,400,463; and Maskasky U.S. Pat. No. 4,435,501. Research Disclosure is published by Kenneth Mason Publications, Ltd., The Old Harbourmaster's, 8 North Street, Emsworth, Hampshire P010 7DD, England.

U.S. Pat. No. 4,656,122 describes silver halide photographic elements capable of producing reversal images including one emulsion layer comprising a blend of tabular silver haloiodide grains and fine grains of a silver salt more soluble than silver iodide.

In U.S. Pat. No. 5,391,468, the addition of dye to high solubility fine grains which are added to an imaging emulsion layer is described. No discussion is present of inter or outerlayers. Again, in U.S. Pat. No. 5,176,990, the dual melting of a liquid emulsion to imaging emulsion layers is described.

U.S. Pat. No. 5,552,265 teaches the use of a small amount of fine grains below the bottom layer to add to the Dmin of the red recording. U.S. Pat. No. 4,614,707 also describes the use of Lippmann emulsions and Dox scavengers below the slow layer to sharpen the toe contrast.

The addition of Lippmann emulsions in interlayers to intercept inhibitor has been described in GB 1,201,110 for reversal films and in U.S. Pat. No. 4,752,701 for color negative film.

It is however, desirable for higher color saturation. Imaging dyes generally have unwanted light absorption which reduce the color saturation. Interimage effect will compensate such unwanted light absorption but more interimage effect is desirable.

It has been reported that the addition of relatively fine grains consisting essentially of a silver salt more soluble than silver iodide to an image forming layer containing tabular silver haloiodide grains can produce a combination of advantages in reversal imaging. The reversal threshold speed of the reversal photographic elements can be increased. At the same time, reduced toe region density in the reversal image as well as increases in maximum density and contrast are observed.

Multi-color photographic element typically have red, green, blue color records (in that order) above the support and interlayers in between color records. Typically a blue light filtration interlayer is added below the blue color record to reduce the blue light exposure of the green and red light sensitive emulsions. A green light filtration interlayer is added below the green color record to reduce the green light exposure of the red light sensitive emulsion.

Multi-color photographic elements typically have red, green, blue color records (in that order) above the support and interlayers in between. The above description applies to other constructions (e.g. blue, red, green three-color-record element, or red, green two-color-record element, and others).

Another way of obtaining higher color saturation is by adding a red light sensitive emulsion above the green color record; or by adding green light sensitive emulsion above the blue light color record. Such layers may contain imaging couplers or may not have any couplers. However, there are several problems with this approach:

1. The extent of color saturation increase is relatively small consequently, a large amount of the red light or green light sensitive emulsion has to be added in such an application.
2. Such large amounts of emulsion addition generate unwanted light absorption by the above red light emulsion or the above green light emulsion, as such emulsion is added above the blue light filtration layer or the green light filtration layer.
3. Such extra emulsions generate extra light scattering, deteriorating the sharpness of the photographic element.

SUMMARY OF THE INVENTION

It has been found that the addition of a large amount of fine grains in one or more overcoat or intercoat layers of a reversal photographic element, in combination with a small amount of green, red or blue light sensitive emulsion in the overcoat or intercoat layer results in the generation of a large color saturation.

This is achieved by forming a photographic element capable of forming a reversal image comprising a support and, coated on said support, at least one image recording emulsion layer comprised of a dispersing medium and radiation sensitive silver halide grains and at least one inter or overcoating layer comprising;

a) a red light, green light or blue light sensitive silver halide emulsion which is less than 10 percent of the mass of the total imaging emulsion in the element; and b) a non-image forming silver halide emulsion having a grain size less than 0.15 μm, and preferably wherein the molar ratio of the grain population of the non-image forming emulsion to that of the image forming emulsion is greater than 3:2 and the surface area ratio of the non-image forming emulsion to the image forming emulsion is more than 2:1.

In a preferred embodiment, a multicolor photographic element capable of forming a variable reversal dye image comprising a support and coated on said support, a blue recording yellow dye image forming layer unit; a green recording magenta dye image forming layer unit; a red recording cyan dye image forming layer unit; and an overcoat comprising:

a) a light sensitive silver halide emulsion which is less than 10 percent of the mass of the total imaging emulsion in the element; and b) a non-image forming silver salt emulsion having a grain size less than 0.15 μm, and the molar ratio of the grain population of the non-image forming emulsion to that of the image forming emulsion is greater than 3:2 and the surface area ratio of the non-image forming emulsion to the image forming emulsion is more than 2:1 is formed.

The combination of the imaging emulsion and the non-imaging emulsion in this special layer gives an increase in interlayer interimage effects, increasing the color of the film.

DETAILED DESCRIPTION OF THE PREFERRED EMBODIMENTS

Figure 1:
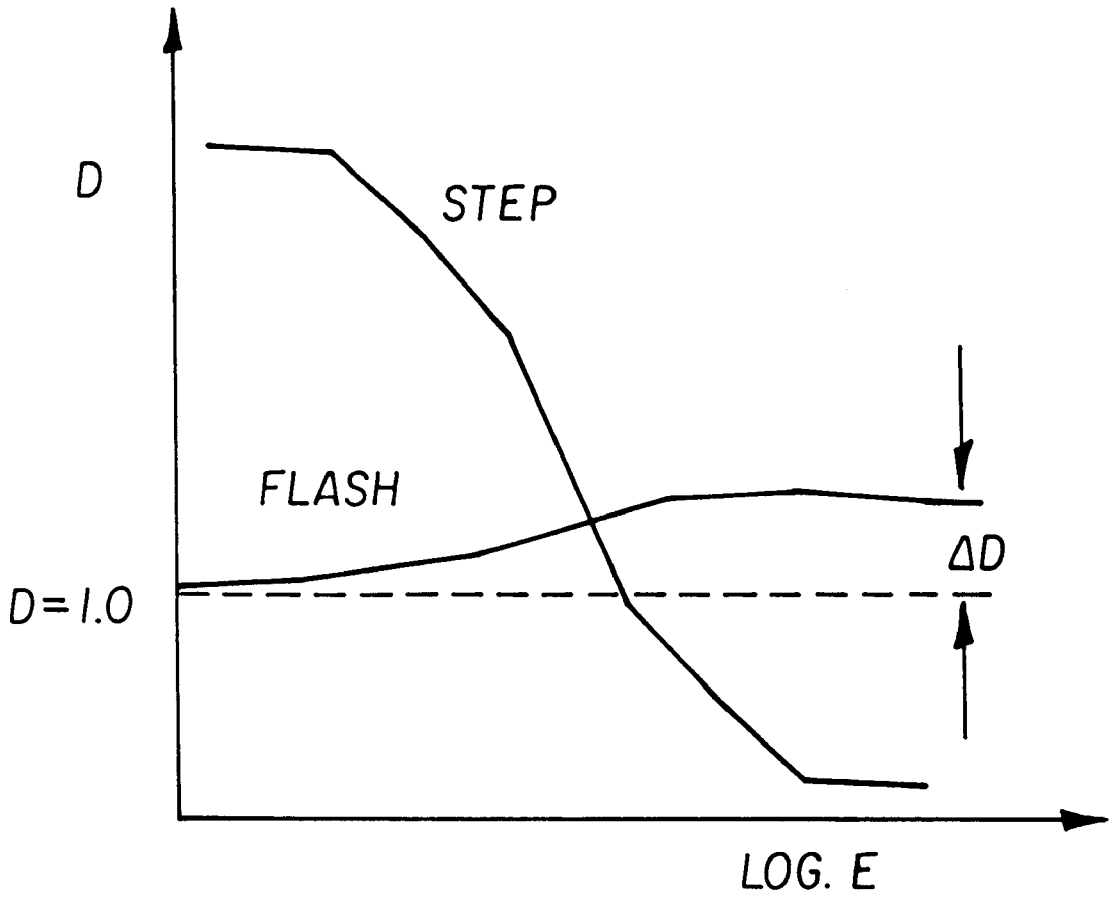
FIG. 1 illustrates the measurement of ΔD interimage response as described in Example 1.

This invention relates to an improvement in silver halide photographic elements useful in reversal imaging. The photographic elements are comprised of a support and one or more image recording silver halide emulsion layers coated on the support. One or more of the image recording emulsion layers contains a dispersing medium and radiation sensitive materials containing silver salts such as tabular silver haloiodide grains.

Photographic element typically consists of imaging layers and non-imaging interlayers. Imaging layers could be red, green or blue light sensitive producing cyan, magenta and yellow dye in subtractive color system. Non-imaging layers include AHU, (antihalation undercoat) interlayer, overcoat layers for UV protection and anti-static.

The red, green, or blue color record can be of any order.

Each color record may contain several emulsions with varying light sensitivity. Each color record may also contain more than one layer, each layer may contain one or more than one type of imaging emulsion plus some non-imaging fine grain emulsions.

The layers of the same color records can be coated next to each other, or could be separated or interleaved with other color records.

Oxidized developer (Dox) scavenger(s) are sometime employed either in the imaging emulsion layer or in a separate interlayer. This is well understood by those skilled in the art.

In addition to the imaging layer(s), the invention requires a special inter or overcoat second layer or interlayer. This interlayer or second layer must be located outside of the image forming layers.

That is, it can be located below all imaging emulsion layer (AHU, undercoat layers). It can also be located above all imaging emulsion layer (overcoat). Or it can be between two imaging emulsion layers (interlayers). This special layer consists of imaging emulsion and non-imaging fine grain emulsion. Therefore this layer is a light sensitive emulsion, but not a dye image forming layer.

This special layer may contain no imaging forming coupler. Or, this special layer may contain a small amount of coupler. Small is relative to the total amount of coupler contained in the whole photographic element. Therefore, this special layer is substantially non-image forming. Thus, this is not the function of the toe speed improving mechanism as disclosed in U.S. Pat. No. 4,656,122.

The special inter or overcoat layer or layers can contain up to 20% of color couplers of the same color.

The imaging emulsion can be, for example, of conventional 3-dimensional morphology or tabular grain morphology. The imaging emulsion in the special layer could be the same imaging emulsions used in the other imaging emulsion layers, or a combination thereof. Or it can be another type of imaging emulsion not used in the other imaging emulsion layers. The imaging emulsion can be of any type of halide composition. The imaging emulsion can be chemical sensitized by any method known in the art. The imaging emulsion can be over-sensitized by any method known in the art. The imaging emulsion can be over-sensitized for extra light sensitivity at the expense of higher fog. The spectral sensitization can be made with similar sensitization dye as the emulsion in the imaging records, or made with different sensitization dye, or made with sensitization dyes from more than one color record. Any means known to improve the spectral sensitizing dye absorption or stability could be applied to the imaging emulsion used in the special layer.

It is preferred to add Dox scavenger in this layer or in the nonimaging layer(s) adjacent to this layer.

The special layer, if placed in an overcoat layer, can be in various positions. It is not necessary to have this layer below the UV protection layer, but it is preferable to have it below the UV layer or merged with the UV layer into one layer.

This invention can be combined with development accelerators (e.g. Lanothane as described in U.S. Pat. No. 5,041,367), surface fogged emulsion, (Carey Lea silver), internally fogged emulsions or internally sensitized emulsion either in the inter or overcoat layer or outside the layer.

This invention can be combined with the use of bleach accelerator releasing compound or a high efficiency coupler to reduce total Ag laydown.

Tabular grains are herein defined as those having two substantially parallel crystal faces, each of which is clearly larger than any other single crystal face of the grain. The tabular grains employed in the blended grain emulsion layers forming one or more layers of the reversal photographic elements of this invention are chosen so that the tabular grains having a thickness of less than 0.5 μm have an average aspect ratio of greater than 8:1 and account for at least 35 percent of the total grain projected area of the blended grain emulsion layer in which they are present.

A convenient approach for preparing blended grain emulsion layers is to blend a radiation sensitive high aspect ratio tabular grain emulsion. The term "high aspect ratio tabular grain emulsion" is herein defined as requiring that the tabular silver halide grains having a thickness of less than 0.3 μm have an average aspect ratio of greater than 8:1 and account for at least 50 percent of the total projected area of the grains present in the emulsion.

In general, tabular grains are preferred having a thickness of less than 0.3 μm. Where the emulsion layer is intended to record blue light as opposed to green or red light, it is advantageous to increase the thickness criterion of the tabular grains to less than 0.5 μm, instead of less than 0.3 μm. Such an increase in tabular grain thickness is also contemplated for applications in which the reversal image is to be viewed without enlargement or where granularity is of little importance, although these latter applications are relatively rare in reversal imaging, reversal images being most commonly viewed by projection. Tabular grain emulsions wherein the tabular grains have a thickness of less than 0.5 μm intended for recording blue light are disclosed by Kofron et al U.S. Pat. No. 4,439,520, cited above.

While the tabular grains satisfying the 0.3 μm thickness criterion account for at least 50 percent of the total projected area of the grains in high aspect ratio tabular grain emulsions, it is appreciated that in blending a second grain population the tabular grain percentage of the total grain projected area is decreased.

Thus, it is apparent that while high aspect ratio tabular grain emulsions are preferred for preparing blended grain emulsions and in a highly preferred form the blended grain emulsions are themselves high aspect ratio tabular grain emulsions, this is not necessary in all instances, and departures can actually be advantageous for specific applications. However, for simplicity the ensuing discussion relating to radiation sensitive tabular grain emulsions is directed to the preferred high aspect ratio tabular grain emulsions, it being appreciated that the teachings are generally applicable to tabular grain emulsions as herein defined.

The preferred high aspect ratio tabular grain silver haloiodide emulsions are those wherein the silver haloiodide grains having a thickness of less than 0.3 μm (optimally less than 0.2 μm) have an average aspect ratio of at least 12:1 and optimally at least 20:1. In a preferred form of the invention these silver haloiodide grains satisfying the above thickness and diameter criteria account for at least 70 percent and optimally at least 90 percent of the total projected area of the silver halide grains. In a highly preferred form of the invention the blended grain emulsions required by this invention also satisfy the parameters set out for the preferred high aspect ratio tabular grain emulsions.

It is appreciated that the thinner the tabular grains accounting for a given percentage of the projected area, the higher the average aspect ratio of the emulsion. Typically the tabular grains have an average thickness of at least 0.03 μm, although even thinner tabular grains can in principle be employed.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be conveniently produced. Maximum average aspect ratios have been observed to vary, depending upon the precipitation technique employed and the tabular grain halide composition. High aspect ratio tabular grain silver haloiodide emulsions with average aspect ratios of 100:1, 200:1, or even higher are obtainable by double-jet precipitation procedures.

The tabular haloiodide grains employed in the practice of this invention contain in addition to iodide at least one of bromide and chloride. Thus, the silver haloiodides specifically contemplated are silver bromoiodides, silver chlorobromoiodides, and silver chloroiodides. Silver bromoiodide emulsions generally exhibit higher photographic speeds and are for this reason the preferred and most commonly employed emulsions for candid photography.

Iodide must be present in the tabular silver haloiodide grains in a concentration sufficient to influence photographic performance. It is thus contemplated that at least about 0.5 mole percent iodide will be present in the tabular silver haloiodide grains. However, high levels of iodide are not required to achieve the advantages of this invention. Generally the tabular silver haloiodide grains contain less than 8 mole percent iodide. Preferred iodide levels in the tabular silver haloiodide grains are from 1 to 7 mole percent and optimally are from 2 to 6 mole percent. All of the above iodide mole percentages are based on total silver present in the tabular grains.

The radiation sensitive tabular haloiodide grains required for the practice of preferred embodiments of this invention are preferably provided by selecting from among the various high aspect ratio tabular grain emulsions disclosed in Research Disclosure Vol. 225, January 1983, Item 22534; Wilgus et al U.S. Pat. No. 4,434,226; Kofron et al U.S. Pat. No. 4,439,520; Solberg et al U.S. Pat. No. 4,433,048; Maskasky U.S. Pat. No. 4,400,463; and Maskasky U.S. Pat. No. 4,435,501; each cited above, which disclose high aspect ratio tabular grain emulsions wherein tabular silver haloiodide grains having a thickness of less than 0.5 μm (preferably 0.3 μm and optimally 0.2 μm), a diameter of at least 0.6 μm, and an average aspect ratio of greater than 8:1 (preferably at least 12:1 and optimally at least 20:1) account for at least 50 (preferably 70 and optimally 90) percent of the total grain projected area.

U.S. Pat. Nos. 4,672,027 and 4,693,964 disclose haloiodide emulsions, specifically bromoiodide emulsions, having a mean diameter in the range of from 0.2 to 0.55 μm including tabular grains having an aspect ratio of greater than 8:1 (preferably at least 12:1) accounting for at least 50 (preferably 70 and optimally 90) percent of the total grains in the emulsion layer. These emulsions are disclosed to exhibit low levels of light scattering when coated over one or more remaining imaging layers. Once the basic precipitation procedure is appreciated, adjustment of other preparation parameters can, if desired, be undertaken by routine optimization techniques.

The blended grain emulsions required can be conveniently provided by blending with a tabular grain silver haloiodide emulsion as described above a second grain population consisting essentially of silver salt which is more soluble than silver iodide. The silver salt should be sufficiently insoluble that it is capable of forming a grain rather than being present in a solubilized form. Useful silver salts can be chosen from among those having a solubility product constant in the range 9.5 to less than 16. Preferred silver salts are those having a solubility product constant in the range of from 9.75 to 15.5, optimally from 11 to 13. Unless otherwise stated, all solubility product constants are referenced to a temperature of 20° C. A discussion and listing of solubility product constants for exemplary silver salts is presented by James, Theory of the Photographic Process, 4th Ed., Macmillan, 1977, Chapter 1, Sections F, G, and H, pp. 5–10.

The reversal photographic elements can take the form of either black-and-white or color reversal photographic elements.

In a very simple form the reversal photographic elements according to this invention can be comprised of a conventional photographic support, such as a transparent film support, onto which is coated a blended grain emulsion layer as described above with the overcoat layer of this invention. Following imagewise exposure, silver halide is imagewise developed to produce a first silver image, which need not be viewable. The first silver image can be removed by bleaching before further development when a silver or silver enhanced dye reversal image is desired. Thereafter, the residual silver halide is uniformly rendered developable by exposure or by fogging. Development produces a reversal image. The reversal image can be either a silver image, a silver enhanced dye image, or a dye image only, depending upon the specific choice of conventional processing techniques employed. The production of silver reversal images is described by Mason, Photographic Processing Chemistry, 1966. Focal Press Ltd., pp. 160–161. If a dye only image is being produced, silver bleaching is usually deferred until after the final dye image is formed.

The reversal photographic elements of this invention are preferably color reversal photographic elements capable of producing multicolor images—e.g., images that at least approximately replicate subject colors. Illustrative of such color reversal photographic elements are those disclosed by Kofron et al U.S. Pat. No. 4,439,520 and Groet U.S. Pat. No. 4,082,553, each cited above and here incorporated by reference. In a simple form such a color reversal photographic element can be comprised of a support having coated thereon at least three color forming layer units, including a blue recording yellow dye image forming layer unit, a green recording magenta dye image forming layer unit, and a red recording cyan dye image forming layer unit. Each color forming layer unit is comprised of at least one radiation sensitive silver halide emulsion layer. In a preferred form of the invention at least one radiation sensitive emulsion layer in each color forming layer unit is comprised of a blended grain emulsion as described above. The blended grain emulsions in each color forming layer unit can be chemically and spectrally sensitized as taught by Kofton et al U.S. Pat. No. 4,439,520. In a preferred form chemical and spectral sensitization of the tabular grain emulsion is completed before blending with the second grain population, which therefore remains substantially free of sensitizing materials. One or more dye image providing materials, such as couplers, are preferably incorporated in each color forming layer unit, but can alternatively be introduced into the photographic element during processing.

The following constitutes a specific illustration of a color reversal photographic element according to this invention.

I. Photographic Support

Exemplary preferred photographic supports include cellulose acetate and poly(ethylene terephthalate) film supports and photographic paper supports, especially a paper support which is partially acetylated or coated with baryta and/or α-olefin containing 2 to 10 carbon atoms, such as polyethylene, polypropylene, and ethylenebutene copolymers.

II. Subbing Layer

To facilitate coating on the photographic support it is preferred to provide a gelatin or other conventional subbing layer.

III. Red Recording Layer Unit

At least one layer comprised of a red sensitized blended grain high aspect ratio tabular grain silver haloiodide emulsion layer, as described in detail above. In an emulsion layer or in a layer adjacent thereto at least one conventional cyan dye image forming coupler is included, such as, for example, one of the cyan dye image forming couplers disclosed in U.S. Pat. Nos. 2,423,730; 2,706,684; 2,725,292; 2,772,161; 2,772,162; 2,801,171; 2,895,826; 2,908,573; 2,920,961; 2,976,146; 3,002,836; 3,034,892; 3,148,062; 3,214,437; 3,227,554; 3,253,924; 3,311,476; 3,419,390; 3,458,315; and 3,476,563.

IV. Interlayer

At least one hydrophilic colloid interlayer, preferably a gelatin interlayer which includes a reducing agent, such as an aminophenol or an alkyl substituted hydroquinone, is provided to act as an oxidized developing agent scavenger.

V. Green Recording Layer Unit

At least one layer comprised of a green sensitized blended grain high aspect ratio tabular grain silver haloiodide emulsion layer, as described in detail above. In an emulsion layer or in a layer adjacent thereto at least one conventional magenta dye image forming coupler is included, such as, for example, one of the magenta dye image forming couplers disclosed in U.S. Pat. Nos. 2,725,292; 2,772,161; 2,895,826; 2,908,573; 2,920,961; 2,933,391; 2,983,608; 3,005,712; 3,006,759; 3,062,653; 3,148,062; 3,152,896; 3,214,437; 3,227,554; 3,253,924; 3,311,476; 3,419,391; 3,432,521; and 3,519,429.

VI. Yellow Filter Layer

A yellow filter layer is provided for the purpose of absorbing blue light. The yellow filter layer can take any convenient conventional form, such as a gelatino-yellow colloidal silver layer (i.e., a Carey Lea silver layer) or a yellow dye containing gelatin layer. In addition the filter layer contains a reducing agent acting as an oxidized developing agent scavenger, as described above in connection with the Interlayer IV.

VII. Blue Recording Layer Unit

At least one layer comprised of a blue sensitized blended grain high aspect ratio tabular grain silver haloiodide emulsion layer, as described in detail above. In an alternative form the tabular grains can be thicker than high aspect ratio tabular grains—that is, the thickness criteria for the grains can be increased from 0.3 μm to less than 0.5 μm, as described above. In this instance the grains exhibit more native blue speed, which preferably is augmented by the use of blue spectral sensitizers, although this is not essential, except for the highest attainable blue speeds. In an emulsion layer or in a layer adjacent thereto at least one conventional yellow dye image forming coupler is included, such, as, for example, one of the yellow dye image forming couplers disclosed in U.S. Pat. Nos. 2,875,057; 2,895,826; 2,908,573; 2,920,961; 3,148,062; 3,227,554; 3,253,924; 3,265,506; 3,277,155; 3,369,895; 3,384,657; 3,408,194; 3,415,652; and 3,447,928.

VIII. Intercoat or Overcoat Layer

The intercoat or overcoat layer of layers of the invention must contain a) a first grain population containing red, blue, or green light sensitive silver halide emulsion which is less than 10 percent of the mass of the total imaging emulsion in the element and b) a non-image forming silver halide emulsion having a grain size less than 0.15 μm, wherein the grain population of the non-imaging emulsion is more soluble than the most insoluble species of the image forming emulsion. Preferably the molar ratio of the grain population of the non-image forming emulsion to that of the image forming emulsion is greater than 3:2 and the surface area ratio of the non-image forming emulsion to the size forming emulsion is more than 2:1.

It is an important feature of the invention that the second grain population is incapable of forming a latent image extending the exposure latitude imparted to the layer by the tabular grains. When the tabular grains have received sufficient light exposure to reach their maximum level of developability, the second grain population has not yet reached a threshold exposure for producing a latent image. The second grain population need not be capable of forming a latent image at any level of exposure, since the latent image forming capability of the second grain population is not utilized in enhancing reversal imaging characteristics. This is what is meant by "non-image forming". However, a second grain population having a latent image forming capability is not excluded from the practice of the invention, provided its threshold exposure level is beyond the intended exposure latitude of the photographic element. Thus, the second grain population preferably requires at least 0.3 log E greater exposure than that required to bring the tabular grains to a maximum level of developability. The relative of insensitivity of the second grain population to exposing radiation as compared to the tabular grains can result from the difference in their mean diameters, the tabular grains in all instances having the larger mean diameter. In most instances and preferably the difference in radiation sensitivity of the two grain populations is increased by chemically sensitizing and/or spectrally sensitizing the only the tabular grains. Although not required, conventional techniques for desensitizing the second grain population can, if desired, be employed. Zelikman et al Making and Coating Photographic Emulsions, Focal Press, 1964, pp. 234–237, illustrate the concept of extending exposure latitude.

It is generally most convenient to prepare the emulsions required for the practice of this invention by blending a tabular silver haloiodide grain emulsion, preferably after sensitization, and a separately prepared emulsion containing the relatively fine second grain population. The relatively fine grain emulsion can, for example, take the form of a relatively fine grain silver chloride, silver bromide, or silver thiocyanate emulsion, the preparations of which are well known to those skilled in the art and form no part of this invention. The relatively fine grain emulsion is optimally a Lippmann emulsion. So long as the grain requirements identified above are satisfied, either or both of the tabular grain containing and relatively fine grain containing emulsions can themselves be the product of conventional grain blending.

The imaging emulsion containing the first grain population must contain less than 10 percent of the mass of the total imaging emulsion in the element. This means that if the blue, green, and red record each has 1 g/m$^2$ of total of imaging emulsion with the total imaging emulsion 3 g/m$^2$, then the imaging emulsion in this special layer should be less than 3 g/m$^2$ times 10%, which means less than 0.3 g/m$^2$ in this special layer. Preferably, the imaging emulsion first grain population in the intercoat or overcoat layer comprises less than 5 percent of the total mass of imaging emulsions in the element.

The non-image forming emulsion containing the second grain population contains silver salt such as silver halide grains having a grain size less than 0.15 $\mu$m preferably, the molar ratio of the second grain population to that of the first grain population is greater than 3:2, preferably greater than 2:1 and more preferably greater than 3:1 and the surface area of ratio of the second grain population to the first grain population is more than 2:1, preferably more than 3:1 and more preferably more than 4:1.

A dye image forming coupler such as C-1, M-1, M-2, Yel-1 may be added to the special layer. The first population of grains in the special layer comprises a red sensitive emulsion, a green sensitive emulsion, a blue sensitive emulsion or any combination thereof.

The second population of grains can comprise a Lippmann, fine cubic emulsion, or fine T-grain emulsion.

At least one additional inter or overcoat layer can be provided. Such layers are typically transparent gelatin layers and contain known addenda for enhancing coating, handling, and photographic properties, such as matting agents, surfactants, antistatic agents, ultraviolet absorbers, and similar addenda.

"Not-substantially-image-forming" means that less than 20% of any one dye produced in the film is produced in this layer. Preferably, less than 7% of any one dye is produced in this layer.

As disclosed by Kofron et al U.S. Pat. No. 4,439,520, the high aspect ratio tabular grain emulsion layers show sufficient differences in blue speed and green or red speed when substantially optimally sensitized to green or red light that the use of a yellow filter layer is not required to achieve acceptable green or red exposure records. It is appreciated that in the absence of a yellow filter layer the color forming layer units can be coated in any desired order on the support. While only a single color forming layer unit is disclosed for recording each of the blue, green, and red exposures, it is appreciated that two, three, or even more color forming layer units can be provided to record any one of blue, green, and red. It is also possible to employ within any or all of the blue, green, and red color forming layers any, some, or all of which satisfy the blended grain emulsion requirements of this invention.

In addition to the features described above the reversal photographic elements can, of course, contain other conventional features known in the art, which can be illustrated by reference to Research Disclosure, vol. 176, December 1978, Item 17643, here incorporated by reference. For example, the silver halide emulsions other than the blended grain emulsions described can be chosen from among those described in Paragraph I; the silver halide emulsions can be chemically sensitized, as described in Paragraph III and/or spectrally sensitized, as described in Paragraph IV, although preferably only the tabular grain silver haloiodide emulsions are sensitized, with the preferred sensitizations those disclosed by Kofton et al U.S. Pat. No. 4,439,520 and Maskasky U.S. Pat. No. 4,435,501; any portion of the elements can contain brighteners, as described in Paragraph V; the emulsion layers can contain antifoggants and stabilizers, as described in Paragraph VI; the color forming layer units can contain color image forming materials as described in Paragraph VII; the elements can contain absorbing and scattering materials, as described in Paragraph VIII; the emulsion and other layers can contain vehicles, as described in Paragraph IX; the hydrophilic colloid and other layers of the elements can contain hardeners, as described in Paragraph X; the layers can contain coating aids, as described in Paragraph XI; the layers can contain plasticizers and lubricants, as described in Paragraph XII; the layers, particularly the layers coated farthest from the support, can contain matting agents, as described in Paragraph XVI; and the supports can be chosen from among those described in Paragraph XVII. In addition conventional time released or imagewise released inhibitors can be used such as those described in U.S. Pat. Nos. 5,567,577 and 3,379,529. This exemplary listing of addenda and features is not intended to restrict or imply the absence of other conventional photographic features compatible with the practice of the invention.

The photographic elements can be imagewise exposed with any various forms of energy, as illustrated by Research Disclosure, Item 17643, cited above, Paragraph XVIII. For multicolor imaging the photographic elements are exposed to visible light.

Multicolor reversal dye images can be formed in photographic elements according to this invention having differentially spectrally sensitized silver halide emulsion layers by black-and-white development followed by color development. Reversal processing is demonstrated below employing conventional reversal processing compositions and procedures.

EXAMPLES

The invention can be better appreciated by reference to the following specific examples. A series of elements of the following layer structure was prepared. The composition of the layer, the coating amount are shown as g/m$^2$. Silver halide amounts are given in silver amounts.

Fine grain emulsions:

EM-1: 0.055 μm, pure bromide Lippmann

EM-2: 0.052 μm, 4.8% iodide, 95.2% bromide Lippmann

EM-3: 0.059 μm, 10% iodide, 90% bromide Lippmann

Example 1

A comparative photographic element 1-1 was constructed in the following manner:

| | | |
|---|---|---|
| **Layer 1: Antihalation Layer** | | |
| Black colloidal Silver | 0.25 | |
| UV Dye UV-1 | 0.04 | |
| Dispersed in Solvent S-1 | 0.04 | |
| Gelatin | 2.44 | |
| **Layer 2: First Interlayer** | | |
| Fine Grain Silver Bromide<br>0.055 μm equivalent spherical diameter | 0.05 | |
| SCV-01 | 0.05 | |
| Gelatin | 1.22 | |
| **Layer 3: Low speed Red Sensitive Layer** | | |
| Silver iodobromide emulsion<br>0.50 μm (diameter) by 0.058 μm (thickness)<br>4% bulk iodide emulsion spectrally sensitized with dyes SD-0 and SD-1 | 0.25 | (as silver) |
| Fine Grain Silver Bromide<br>0.055 μm equivalent spherical diameter | 0.04 | |
| Cyan Coupler C-1 | 0.09 | |
| Dispersed in Solvent S-3 | 0.04 | |
| Gelatin | 1.08 | |
| **Layer 4: Medium Speed Red Sensitive Layer** | | |
| Silver Iodobromide Emulsion<br>0.88 μm (diameter) by 0.091 μm (thickness)<br>4% bulk iodide<br>spectrally sensitized with dyes SD-0 and SD-1 | 0.34 | (as silver) |
| Fine Grain Silver Bromide<br>0.055 μm equivalent spherical diameter | 0.05 | |
| Cyan Coupler C-1 | 0.41 | |
| Dispersed in Solvent S-3 | 0.20 | |
| Gelatin | 0.73 | |

-continued

| | | |
|---|---|---|
| **Layer 5: High Speed Red Sensitive Layer** | | |
| Silver Iodobromide Emulsion<br>1.11 μm (diameter) by 0.103 μm (thickness)<br>3% bulk iodide<br>spectrally sensitized with dyes SD-0 and SD-1 | 0.46 | (as silver) |
| Fine Grain Silver Bromide<br>0.15 μm equivalent spherical diameter<br>4.8% bulk iodide<br>spectrally sensitized | 0.05 | |
| Fine Grain Silver Bromide<br>0.055 μm equivalent spherical diameter | 0.03 | |
| Cyan Coupler C-1 | 0.70 | |
| Dispersed in Solvent S-3 | 0.35 | |
| Gelatin | 1.19 | |
| **Layer 6: Second Interlayer** | | |
| Filter Dye FD-1 | 0.06 | |
| Inhibitor I-1 | 0.001 | |
| SCV-01 | 0.16 | |
| Gelatin | 0.81 | |
| **Layer 7: Third Interlayer** | | |
| Gelatin | 0.61 | |
| **Layer 8: Low Speed Green Sensitive Layer** | | |
| Silver Iodobromide Emulsion<br>0.44 μm (diameter) by 0.057 μm (thickness)<br>4% bulk iodide<br>spectrally sensitized with dyes SD-4 and SD-5 | 0.31 | (as silver) |
| Fine Grain Silver Bromide<br>0.055 μm equivalent spherical diameter | 0.04 | (as silver) |
| Magenta Coupler M-1 | 0.07 | |
| Magenta Coupler M-2 | 0.03 | |
| co-dispersed in Solvent S-2 | 0.05 | |
| Gelatin | 0.47 | |
| **Layer 9: Medium Speed Green Sensitive Layer** | | |
| Silver Iodobromide Emulsion<br>0.64 μm (diameter) by 0.105 μm (thickness)<br>3% bulk iodide<br>spectrally sensitized with dyes SD-4 and SD-5 | 0.38 | (as silver) |
| Magenta Coupler M-1 | 0.34 | |
| Magenta Coupler M-2 | 0.15 | |
| Co-dispersed in Solvent S-2 | 0.25 | |
| Gelatin | 0.91 | |
| **Layer 10: High Speed Green Sensitive Layer** | | |
| Silver Iodobromide Emulsion<br>1.26 μm (diameter) by 0.137 μm (thickness)<br>3% bulk iodide<br>spectrally sensitized with dyes SD-4 and SD-5 | 0.54 | (as silver) |
| Fine Grain Silver Iodobromide emulsion<br>0.15 μm equivalent spherical diameter<br>4.8% bulk iodide<br>spectrally sensitized | 0.04 | (as silver) |
| Magenta Coupler M-1 | 0.72 | |
| Magenta Coupler M-2 | 0.31 | |
| Co-dispersed in Solvent S-2 | 0.52 | |
| Gelatin | 1.78 | |
| **Layer 11: Fourth Interlayer** | | |
| Gelatin | 0.61 | |
| **Layer 12: Fifth Interlayer** | | |
| Carey Lea Silver | 0.07 | |
| SCV-01 | 0.11 | |
| Gelatin | 0.68 | |
| **Layer 13: Low Speed Blue Sensitive Layer** | | |
| Silver Iodobromide Emulsion<br>1.04 μm (diameter) by 0.125 μm (thickness)<br>3% bulk iodide<br>spectrally sensitized with dyes SD-6 and Sd-7 | 0.22 | (as silver) |
| Silver Iodobromide Emulsion<br>0.50 μm (diameter) by 0.130 μm (thickness)<br>3% bulk iodide<br>spectrally sensitized with dyes SD-6 and SD-7 | 0.15 | (as silver) |
| Yellow Coupler YEL-1 | 0.89 | |
| Dispersed in Solvent S-3 | 0.30 | |

-continued

| | | |
|---|---|---|
| Gelatin | 1.23 | |
| Layer 14: High Speed Blue Sensitive Layer | | |
| Silver Iodobromide Emulsion<br>2.59 μm (diameter) by 0.154 μm (thickness)<br>2% bulk iodide<br>spectrally sensitized with dyes SD-6 and SD-7 | 0.67 | (as silver) |
| Yellow Coupler YEL-1 | 1.53 | |
| Dispersed in Solvent S-3 | 0.51 | |
| Gelatin | 2.03 | |
| Layer 15: First Overcoat | | |
| SCV-01 | 0.07 | |
| UV Dye UV-4 | 0.41 | |
| UV Dye UV-1 | 0.09 | |
| Dispersed in Latex L-1 | 0.45 | |
| Gelatin | 1.40 | |
| Layer 16: Second Overcoat | | |
| Gelatin | 0.65 | |
| Layer 17: Third Overcoat | | |
| Fine Grain Silver Bromide<br>0.055 μm equivalent spherical diameter | 0.12 | (as silver) |
| Matte<br>3.3 μm spherical diameter | 0.02 | |
| Hardener H-1 | 1.38% | of total gel |
| Gelatin | 0.97 | |

Another comparative photographic element 1-2 was conducted similar to element 1-1 except extra component was placed in Layer 16, as indicated below:

| Layer 16: Second Overcoat | |
|---|---|
| Low speed green sensitive imaging Emulsion (as silver) | 0.09 |
| Magenta Coupler M-1 | 0.07 |
| Magenta Coupler M-2 | 0.03 |
| Co-dispersed in Solvent S-2 | 0.05 |
| Gelatin | 0.80 |

One invention photographic element 1-3 was constructed similar to element 1-1 except extra components were placed in Layer 16, as indicated below:

| Layer 16: Second Overcoat | |
|---|---|
| Low speed green sensitive imaging emulsion | 0.09 (as silver) |
| Fine Grain Silver Bromide EM-1<br>0.055 μm equivalent spherical diameter | 0.45 (as silver) |
| Magenta Coupler M-1 | 0.07 |
| Magenta Coupler M-2 | 0.03 |
| Co-dispersed in Solvent S-2 | 0.05 |
| Gelatin | 0.80 |

Another photographic element of the invention 1-4 was constructed similar to element 1-1 except extra components were placed in Layer 16, as indicated below:

| Layer 16: Second Overcoat | |
|---|---|
| Low speed green sensitive imaging emulsion | 0.16 (as silver) |
| Fine Grain Silver Bromide EM-1<br>0.055 μm equivalent spherical diameter | 0.45 (as silver) |
| Magenta Coupler M-1 | 0.07 |
| Magenta Coupler M-2 | 0.03 |
| Co-dispersed in Solvent S-2 | 0.05 |
| Gelatin | 0.80 |

The imaging emulsion and fine grain emulsion were made in different melts and mixed right before coating event (dual melting).

The IIE measurement is described in U.S. Pat. No. 4,082,553 and is described further in FIG. 1. The exposed strips were processed in standard E-6 process. The G on B IIE is measured from step exposure of green record (causer layer) and flash exposure of the blue color record (receiver layer). The ΔD value is report at the blue density at the lowest green exposure. This ΔD value is report at the blue density being D=1.0 at the lowest green exposure. (Likewise the ΔD for R on G IIE or R on B IIE are similarly measured). The other IIE terms were found not significantly changed in this group of samples as seen in Table 1.

The metric ΔD is a measure of IIE response. It characterizes the increase in density of the flashed record caused by the decrease in density of the stepped record.

TABLE 1

| | Emulsion in Layer 16 | | |
|---|---|---|---|
| Example | Low Speed Green | Fine Grain EM-1 | G on B IIE (@ D = 1.0) ΔD |
| 1-1, comparison | 0 | 0 | 0.48 |
| 1-2, comparison | 0.09 | 0 | 0.51 |
| 1-3, invention | 0.09 | 0.43 | 0.84 |
| 1-4, invention | 0.16 | 0.43 | 0.87 |

The above example demonstrates that adding imaging emulsion only will not generate big IIE effect, while the combination of imaging emulsion and high level of fine grain non-imaging emulsion produced significantly higher IIE effect.

Example 2

A comparative photographic element 2-1 was constructed in a similar manner as element 1-1 from Layer 1 to Layer 15. Layer 16 was listed below and there was no Layer 17.

Layer 16: Second Overcoat

| | |
|---|---|
| Matte<br>3.3 μm spherical diameter | 0.02 |
| Hardener H-1 | 1.38% of total gel |
| Gelatin | 0.97 |

Six invention photographic elements 2-2 to 2-7 were constructed similar to element 2-1 except additional components were added to Layer 15 according to the table below:

TABLE 2

| Example | Emulsion in Layer 15: Light sensitive emulsion level and type | Emulsion in Layer 15: Fine Grain Emulsion EM-1 | G on B IIE (@ D = 1.0) ΔD |
|---|---|---|---|
| 2-1, comparison | 0 | 0 | 0.33 |
| 2-2, invention | 0.04, Low speed Green | 0.65 | 0.41 |
| 2-3, invention | 0.09, High speed Green | 0.43 | 0.42 |
| 2-4, invention | 0.04, Medium speed Green | 0.54 | 0.45 |
| 2-5, invention | 0.09, Medium speed Green | 0.43 | 0.47 |
| 2-6, invention | 0.04, Low speed Green | 0.43 | 0.49 |
| 2-7, invention | 0.09, Medium speed Green | 0.65 | 0.51 |

The above example showed that appropriate ratio of imaging emulsion and high level of fine grains emulsion can improve IIE significantly.

Example 3

A comparative photographic element 3-1 was constructed in a similar manner as element 2-1 except for the difference in Layer 16.

Layer 16: Second Overcoat

| | |
|---|---|
| Fine Grain Silver Bromide 0.055 μm equivalent spherical diameter | 0.12 (as silver) |
| Matte 3.3 μm spherical diameter | 0.02 |
| Hardener H-1 | 1.38% of total gel |
| Gelatin | 0.97 |

In addition to the G on B IIE, R on B and R on G IIE are also measured. The other IIE terms were found not significantly changed.

An invention photographic element 3-2 was constructed similar to element 3-1 except additional components were added to Layer 15 according to Table 3 below:

The above example showed that by two type of light sensitive emulsions, several IIE terms can be improved all at the same time. In example 1 and 2, when green light sensitive emulsion was used, only G on B IIE term was improved.

Example 4

A comparative photographic element 4-1 was constructed in exactly the same manner as element 2-1.

Six invention photographic elements 4-2 to 4-7 were constructed similar to element 4-1 except additional components were added to Layer 15 according to Table 4 below:

TABLE 3

| Example | Emulsion in Layer 15: Light Sensitive Emulsion Level and Type | Emulsion in Layer 15: Fine Grain Emulsion EM-1 | R on G IIE (@D = 1.0) ΔD | R on B IIE (@D = 1.0) ΔD | G on B IIE (@D = 1.0) ΔD |
|---|---|---|---|---|---|
| 3-1, comparison | 0 | 0 | 0.40 | 0.36 | 0.45 |
| 3-2, invention | 0.09 of High Speed Red and 0.04 of Medium Speed Green | 0.43 | 0.46 | 0.49 | 0.60 |

TABLE 4

| Example | Emulsion in Layer 15: Light Sensitive Emulsion Level and Type | Emulsion in Layer 15: Fine Grain Emulsion EM-1 | R on G IIE (@D = 1.0) ΔD | R on B IIE (@D = 1.0) ΔD | G on B IIE (@D = 1.0) ΔD |
|---|---|---|---|---|---|
| 4-1, comparison | 0 | 0 | 0.34 | 0.28 | 0.32 |

TABLE 4-continued

| Example | Emulsion in Layer 15: Light Sensitive Emulsion Level and Type | Fine Grain Emulsion EM-1 | R on G IIE (@D = 1.0) ΔD | R on B IIE (@D = 1.0) ΔD | G on B IIE (@D = 1.0) ΔD |
|---|---|---|---|---|---|
| 4-2, invention | 0.17 High Speed Red | 0.86 | 0.50 | 0.37 | 0.31 |
| 4-3, invention | 0.17 High Speed Red | 0.65 | 0.48 | 0.42 | 0.33 |
| 4-4, invention | 0.17 High Speed Red | 0.43 | 0.45 | 0.44 | 0.30 |
| 4-5, invention | 0.09 High Speed Red | 0.43 | 0.43 | 0.41 | 0.32 |
| 4-6, invention | 0.09 Medium Speed Red | 0.43 | 0.44 | 0.43 | 0.31 |
| 4-7, invention | 0.09 Low Speed Red | 0.43 | 0.46 | 0.43 | 0.33 |

The above example that using cyan emulsions in the second overcoat, R on G and R on B IIE terms can be significantly improved. G on B IIE did not improve.

Example 5

One invention photographic element 5-2 was constructed similar to element 4-1 except additional components was added to Layer 15 accordingly to Table 5 below:

TABLE 5

| Example | Emulsion in Layer 15: Light Sensitive Emulsion Level and Type | Fine Grain Emulsion EM-1 | R on G IIE (@D = 1.0) ΔD | R on B IIE (@D = 1.0) ΔD | G on B IIE (@D = 1.0) ΔD |
|---|---|---|---|---|---|
| 4-1, comparison | 0 | 0 | 0.34 | 0.28 | 0.32 |
| 5-2, invention | 0.17 of High Speed Red and 0.09 of Medium Speed Green | 0.86 | 0.43 | 0.41 | 0.44 |

The above example showed that by adding an appropriate amount and type of imaging emulsion, all R on G, R on B and G on B IIE terms can be improved.

Example 6

A comparative photographic element 6-1 was constructed in the following manner:

| | |
|---|---|
| Layer 1: Anihalation Layer | |
| Black colloidal Silver | 0.25 |
| UV Dye UV-1 | 0.04 |
| Dispersed in Solvent S-1 | 0.04 |
| Gelatin | 2.44 |
| Layer 2: First Interlayer | |
| Fine Grain Silver Bromide 0.055 μm equivalent spherical diameter | 0.05 |
| SCV-01 | 0.05 |
| Gelatin | 1.22 |
| Layer 3: Low Speed Red Sensitive Layer | |
| Silver Iodobromide Emulsion 0.50 μm (diameter) by 0.058 μm (thickness) | 0.25 (as silver) |

-continued

| | |
|---|---|
| 4% bulk iodide spectrally sensitized with dyes SD-0 and SD-1 | |
| Fine Grain Silver Bromide 0.055 μm equivalent spherical diameter | 0.04 |
| Cyan Coupler C-1 | 0.09 |
| Dispersed in Solvent S-3 | 0.04 |
| Gelatin | 1.08 |

-continued

| | |
|---|---|
| Layer 4: Medium Speed Red Sensitive Layer | |
| Silver Iodobromide Emulsion 0.88 μm (diameter) by 0.091 μm (thickness) 4% bulk iodide spectrally sensitized with dyes SD-0 and SD-1 | 0.34 (as silver) |
| Fine Grain Silver Bromide 0.055 μm equivalent spherical diameter | 0.05 |
| Cyan Coupler C-1 | 0.41 |
| Dispersed in Solvent S-3 | 0.20 |
| Gelatin | 0.73 |
| Layer 5: High Speed Red Sensitive Layer | |
| Silver Iodobromide Emulsion 1.11 μm (diameter) by 0.103 μm (thickness) 3% bulk iodide spectrally sensitized with dyes SD-0 and SD-1 | 0.46 (as silver) |
| Fine Grain Silver Bromide 0.15 μm equivalent spherical diameter 4.8% bulk iodide spectrally sensitized | 0.05 |
| Fine Grain Silver Bromide 0.055 μm equivalent spherical diameter | 0.03 |
| Cyan Coupler C-1 | 0.70 |
| Dispersed in Solvent S-3 | 0.35 |
| Gelatin | 1.19 |

-continued

| | |
|---|---|
| Layer 6: Second Interlayer | |
| Filter Dye FD-1 | 0.06 |
| Inhibitor I-1 | 0.001 |
| SCV-01 | 0.16 |
| Gelatin | 0.81 |
| Layer 7: Third Interlayer | |
| Gelatin | 0.61 |
| Layer 8: Low Speed Green Sensitive Layer | |
| Silver Iodobromide Emulsion<br>0.44 μm (diameter) by 0.057 μm (thickness)<br>4% bulk iodide<br>spectrally sensitized with dyes SD-4 and SD-5 | 0.31 (as silver) |
| Fine Grain Silver Bromide<br>0.055 μm equivalent spherical diameter | 0.04 (as silver) |
| Magenta Coupler M-1 | 0.07 |
| Magenta Coupler M-2 | 0.03 |
| Co-dispersed in Solvent S-2 | 0.05 |
| Gelatin | 0.47 |
| Layer 9: Medium Speed Green Sensitive Layer | |
| Silver Iodobromide Emulsion<br>0.64 μm (diameter) by 0.105 μm (thickness)<br>3% bulk iodide<br>spectrally sensitized with dyes SD-4 and SD-5 | 0.38 (as silver) |
| Magenta Coupler M-1 | 0.34 |
| Magenta Coupler M-2 | 0.15 |
| Co-dispersed in Solvent S-2 | 0.25 |
| Gelatin | 0.91 |
| Layer 10: High Speed Green Sensitive Layer | |
| Silver Iodobromide Emulsion<br>1.26 μ, (diameter) by 0.137 μm (thickness)<br>3% bulk iodide<br>spectrally sensitized with dyes SD-4 and SD-5 | 0.54 (as silver) |
| Fine Grain Silver Iodobromide Emulsion<br>0.15 μm equivalent spherical diameter<br>4.8% bulk iodide<br>spectrally sensitized | 0.04 (as silver) |
| Magenta Coupler M-1 | 0.72 |
| Magenta Coupler M-2 | 0.31 |
| Co-dispersed in Solvent S-2 | 0.52 |
| Gelatin | 1.78 |
| Layer 11: Fourth Interlayer | |
| Gelatin | 0.61 |
| Layer 12: Fifth Interlayer | |
| Carey Lea Silver | 0.07 |
| Gelatin | 0.68 |
| Layer 13: Sixth Interlayer | |
| SCV-01 | 0.11 |
| Gelatin | 0.61 |
| Layer 14: Low Speed Blue Sensitive Layer | |
| Silver Iodobromide Emulsion<br>1.04 μm (diameter) by 0.125 μm (thickness)<br>3% bulk iodide<br>spectrally sensitized with dyes SD-6 and SD-7 | 0.22 (as silver) |
| Silver iodobromide Emulsion<br>0.50 μm (diameter) by 0.130 μm (thickness)<br>3% bulk iodide<br>spectrally sensitized with dyes SD-6 and SD-7 | 0.15 (as silver) |
| Yellow Coupler YEL-1 | 0.89 |
| Dispersed in Solvent S-3 | 0.30 |
| Gelatin | 1.23 |
| Layer 15: High Speed Blue Sensitive Layer | |
| Silver Iodobromide Emulsion<br>2.59 μm (diameter) by 0.154 μm (thickness)<br>2% bulk iodide<br>spectrally sensitized with dyes SD-6 and SD-7 | 0.67 (as silver) |
| Yellow Coupler YEL- 1 | 1.53 |
| Dispersed in Solvent S-3 | 0.51 |
| Gelatin | 2.03 |

-continued

| | |
|---|---|
| Layer 16: First Overcoat | |
| SCV-01 | 0.07 |
| UV Dye UVA | 0.41 |
| UV Dye UV-1 | 0.09 |
| Dispersed in Latex L-1 | 0.45 |
| Gelatin | 1.40 |
| Layer 17: Second Overcoat | |
| Fine Grain Silver Bromide<br>0.055 μm equivalent spherical diameter | 0.12 (as silver) |
| Fine Grain Silver Iodobromide Emulsion<br>0.6 μm cube<br>3% bulk iodide<br>pre-fogged | 0.01 (as silver) |
| Matte<br>3.3 μm spherical diameter | 0.02 |
| Hardener H-1 | 1.38% of total gel |
| Gelatin | 0.97 |

The comparison example, example 6-1, had no imaging emulsion nor fine grain emulsion in First overcoat (layer 16).

An invention example, example 6-2, had similar coating structure as example 6-1 except following modifications: the sixth interlayer (layer 13) was left out, one extra interlayer was added between layer 15 and layer 16 (layer 15a), the following changes were made in layer 16, and all components in layer 14 and 15 were increased by 16%.

| | |
|---|---|
| Layer 15a: Extra Interlayer | |
| SCV-01 | 0.16 |
| Gelatin | 0.61 |
| Layer 16: First Overcoat (the special layer) | |
| UV Dye UV-4 | 0.41 |
| UV Dye UV-1 | 0.09 |
| Dispersed in Latex L-1 | 0.45 |
| Low Speed Cyan Imaging Emulsion (red light sensitive) | 0.09 |
| Fine Grain Iodobromide Emulsion (EM-2)<br>0.05 μm equivalent spherical diameter<br>4.8% iodide | 0.43 |
| Gelatin | 1.40 |

An invention example, example 6-3, had similar coating structure as example 6-1 except following modifications: the sixth interlayer (layer 13) was left out, two extra interlayers were added between layer 15 and layer 16 (layer 15a and 15b) and changes made in layer 16. All components in layer 14 and 15 were increased by 16%.

| | |
|---|---|
| Layer 15a: Extra Interlayer | |
| SCV-01 | 0.16 |
| Gelatin | 0.61 |
| Layer 15b: Extra Interlayer (the special layer) | |
| Low Speed Cyan Imaging Emulsion | 0.09 (as silver) |
| Fine Grain Iodobromide Emulsion (EM-2)<br>0.05 μm equivalent spherical diameter<br>4.8% iodide | 0.43 (as silver) |
| Gelatin | 0.51 |
| Layer 16: First Overcoat | |
| UV Dye UV-4 | 0.41 |
| UV Dye UV-1 | 0.09 |
| Dispersed in Latex L-1 | 0.45 |
| Gelatin | 1.40 |

TABLE 6

| Examples | Coating | R on G IIE (@D = 1.0) ΔD | R on B IIE (@D = 1.0) ΔD | G on B IIE (@D = 1.0) ΔD |
|---|---|---|---|---|
| 6-1 Comparison | 6-1 | 0.34 | 0.24 | 0.22 |
| 6-2 Invention | 6-2 | 0.53 | 0.59 | 0.35 |
| 6-3 Invention | 6-3 | 0.54 | 0.65 | 0.45 |

The above example, in conjunction with example 1 to 5, showed the IIE advantage can be obtained by placing the special layer in various places in overcoat layers.

Comparative Example 6

Photographic elements 6-4–6-6 were constructed similar to 6-2 except the imaging emulsion and fine grains component variation in layer 16 are listed in the following table.

TABLE 6a

| | Emulsion in Layer 16 | | |
|---|---|---|---|
| Examples | Light Sensitive Emulsion Level and Type | Fine Grain Emulsion EM-1 | G on B IIE (@D = 1.0) ΔD |
| 6-4 Comparison | 0 | 0 | 0.38 |
| 6-5, Comparison | 0.04 Medium Speed Green and 0.08 Fast Speed Red | 0.00 | 0.35 |
| 6-6, Comparison | 0 | 0.65 | 0.37 |
| Invention | 0.04 Medium Speed Green and 0.08 Fast Speed Red | 0.65 | 0.47 |

It is noted that neither the addition of fine grain component alone nor the addition of imaging emulsion alone result in an increased IIE term. This effect however, is obtained by the addition of both components.

Example 7

A comparative photographic element 7-1 was constructed in the following manner:

| | |
|---|---|
| Layer 1: Antihalation Layer | |
| Black colloidal Silver | 0.43 |
| UV Dye UV-1 | 0.04 |
| Dispersed in Solvent S-1 | 0.04 |
| Gelatin | 2.44 |
| Layer 2: First Interlayer | |
| Fine Grain Silver Bromide 0.055 μm equivalent spherical diameter | 0.05 |
| SCV-01 | 0.05 |
| Gelatin | 1.22 |
| Layer 3: Low Speed Red Sensitive Layer | |
| Silver Iodobromide Emulsion 4% bulk iodide spectrally sensitized with dyes SD-2 and SD-3 | 0.59 (as silver) |
| Cyan Coupler C-1 | 0.19 |
| Dispersed in Solvent S-3 | 0.10 |
| Gelatin | 0.86 |

-continued

| | |
|---|---|
| Layer 4: High Speed Red Sensitive Layer | |
| Silver Iodobromide Emulsion 4% bulk iodide spectrally sensitized with dyes SD-2 and SD-3 | 0.70 (as silver) |
| Cyan Coupler C-1 | 1.10 |
| Dispersed in Solvent S-3 | 0.55 |
| Gelatin | 1.83 |
| Layer 5: Second Interlayer | |
| Filter Dye FD-1 | 0.06 |
| Inhibitor I-1 | 0.001 |
| SCV-01 | 0.16 |
| Gelatin | 0.81 |
| Layer 6: Third Interlayer | |
| Gelatin | 0.61 |
| Layer 7: Low Speed Green Sensitive Layer | |
| Silver Iodobromide Emulsion 4% bulk iodide spectrally sensitized with dyes SD-4 and SD-5 | 0.59 (as silver) |
| Magenta Coupler M-1 | 0.06 |
| Magenta Coupler M-2 | 0.15 |
| Co-dispersed in Solvent S-2 | 0.11 |
| Gelatin | 0.86 |
| Layer 8: High Speed Green Sensitive Layer | |
| Silver Iodobromide Emulsion 4% bulk iodide spectrally sensitized with dyes SD-4 and SD-5 | 0.59 (as silver) |
| Magenta Coupler M-1 | 0.29 |
| Magenta Coupler M-2 | 0.68 |
| Co-dispersed in Solvent S-2 | 0.48 |
| Gelatin | 1.67 |
| Layer 9: Fourth Interlayer | |
| Gelatin | 2.15 |
| Layer 10: Fifth Interlayer | |
| Filter Dye FD-2 | 0.20 |
| SCV-01 | 0.11 |
| Gelatin | 0.61 |
| Layer 11: Low Speed Blue Sensitive Layer | |
| Silver Iodobromide Emulsion 3% bulk iodide spectrally sensitized with dyes SD-8 | 0.25 (as silver) |
| Fine Grain Silver Bromide 0.055 μm equivalent spherical diameter | 0.02 (as silver) |
| Yellow Coupler YEL-1 | 0.59 |
| Dispersed in Solvent S-3 | 0.20 |
| Gelatin | 0.86 |
| Layer 12: High Speed Blue Sensitive Layer | |
| Silver Iodobromide Emulsion 3% bulk iodide spectrally sensitized with dyes SD-8 | 0.70 (as silver) |
| Yellow Coupler YEL-1 | 1.59 |
| Dispersed in Solvent S-3 | 0.53 |
| Gelatin | 2.37 |
| Layer 13: First Overcoat | |
| SCV-01 | 0.07 |
| UV Dye UV-4 | 0.38 |
| UV Dye UV-1 | 0.09 |
| Dispersed in Latex L-1 | 0.45 |
| Gelatin | 1.40 |
| Layer 14: Second Overcoat | |
| Fine Grain Silver Bromide 0.055 μm equivalent spherical diameter | 0.12 (as silver) |
| Matte 3.3 μm spherical diameter | 0.02 |
| Hardener H-1 | 1.5% of total gel |
| Gelatin | 0.97 |

One invention photographic element 7-2 was constructed similar to element 7-1 except one additional layer (Layer 2a) was placed between Layer 2 and Layer 3 while Layer 6 was omitted:

| | |
|---|---|
| Layer 2a: | |
| Low speed red sensitive Emulsion | 0.59 (as silver) |
| Fine Grain Silver Bromide EM-1 | 0.43 (as silver) |
| 0.055 μm equivalent spherical diameter | |
| Gelatin | 0.86 |

Another invention photographic element 7-3, was constructed similar to element 7-2 except that the fine grain were EM-3 instead of EM-1.

TABLE 7

| | Component in Layer 2a | | |
|---|---|---|---|
| Coating | Slow Red Sensitive Emulsion | Fine Grain Emulsion | R on G IIE (@D = 1.0) ΔD |
| 7-1, comparison | N/A | N/A | 0.46 |
| 7-2, invention | 0.59 | 0.43 EM-1 | 0.70 |
| 7-3, invention | 0.59 | 0.43 EM-3 | 0.85 |

Example 8

A comparative photographic element 8-1 was constructed exactly the same as element 7-1.

Two comparative photographic elements 8-2 and 8-3 and two invention photographic elements 8-4 and 8-5 were constructed similar to element 8-1 except additional components were added to Layer 6 according to the table below:

| | |
|---|---|
| Layer 6: | |
| Low or High speed Green Sensitive Emulsion | 0.59 (as silver) |
| Fine Grain Silver Bromide EM-1 | 0.43 or 0.00 (as silver) |
| 0.055 μm equivalent spherical diameter | |
| Gelatin | 0.76 |

TABLE 8

| | Component in Layer 6 | | |
|---|---|---|---|
| Coating | Light Sensitive Emulsion | Fine Grain Emulsion EM-1 | G on R IIE (@D = 1.0) ΔD |
| 8-1, comparison | none | none | 0.29 |
| 8-2, comparison | 0.59 High speed green | none | 0.21 |
| 8-3, comparison | 0.59 Low speed green | none | 0.24 |
| 8-4, invention | 0.59 High speed green | 0.43 | 0.41 |
| 8-5, invention | 0.59 Low speed green | 0.43 | 0.39 |

Example 9

A comparative photographic element 9-1 was constructed in exactly the same manner as element 6-1. Photographic element 9-2 was constructed similar to 9-1 except following changes:

| | |
|---|---|
| Layer 2: | |
| No Fine Grain Silver Bromide Carey Lea Silver | 0.005 |
| Layer 3, 4 and 5: | |
| All components were increased by 10% | |
| Layer 7: | |
| Carey Lea Silver | 0.002 |
| Layer 8, 9 and 10: | |
| All components were increased by 5% | |
| Layer 12: | |
| SCV-01 | 0.11 |
| Layer 13: | |
| Omitted | |
| Layer 14: | |
| All components were increased by 16% | |
| Layer 15: | |
| All components were increased by 16% | |
| Layer 15a: | |
| SCV-01 | 0.16 |
| Gelatin | 0.61 |
| Layer 16: | |
| UV Dye UV-4 | 0.41 |
| UV Dye UV-1 | 0.09 |
| Dispersed in Latex L-1 | 0.45 |
| Low Speed Red Sensitive Emulsion | 0.09 |
| Fine Grain Bromide Emulsion (EM-1) | 0.43 |
| 0.05 μm equivalent spherical diameter | |
| 4.8% iodide | |
| Gelatin | 1.40 |

Photographic element 9-3 was constructed similar to 9-2 except following changes:

| | |
|---|---|
| Layer 16: | |
| Low Speed Red Sensitive Emulsion | 0.18 |
| Fine Grain Bromide Emulsion (EM-1) | 0.86 |

TABLE 9

| | R on G IIE (@D = 1.0) ΔD | R on B IIE (@D = 1.0) ΔD | G on B IIE (@D = 1.0) ΔD |
|---|---|---|---|
| 9-1, comparison | 0.35 | 0.22 | 0.19 |
| 9-2, invention | 0.58 | 0.49 | 0.27 |
| 9-3, invention | 0.70 | 0.72 | 0.44 |

In the presence of CLS below the low speed green light sensitive emulsion layer and the low speed red light sensitive emulsion layer, the current invention particularly amplifies the interimage effect as observed by these large IIE increase.

The components employed for the preparation of light-sensitive materials not already identified above are shown below:

SCV-1:
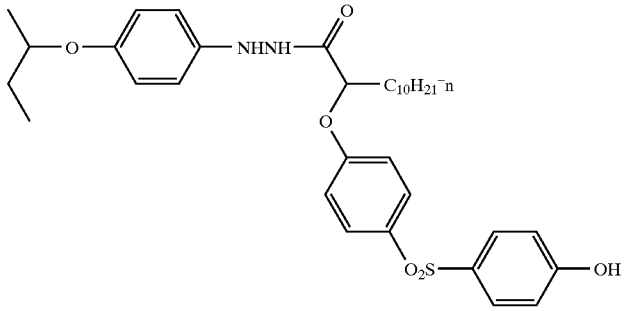
C-1:
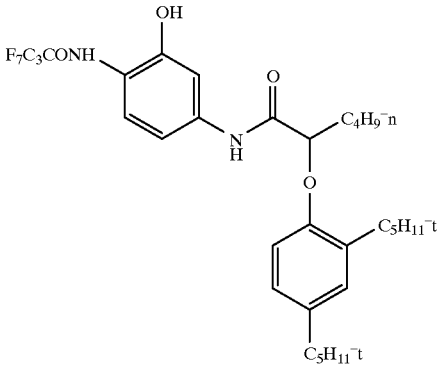
M-1:
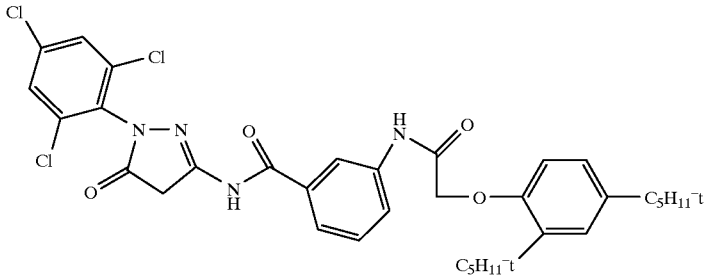
M-2:
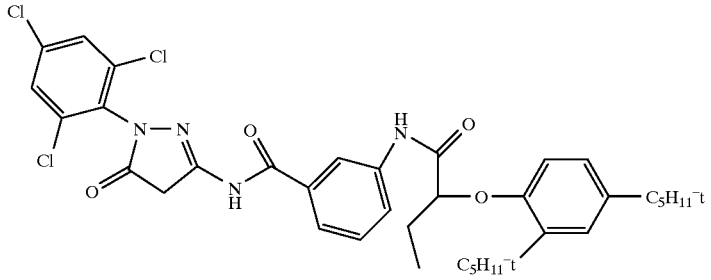

-continued
YEL-1:
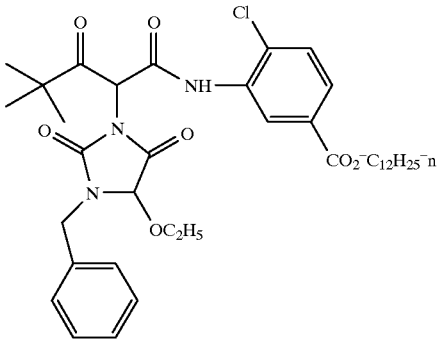
FD-1
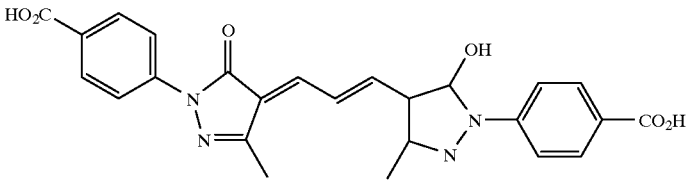
FD-2:
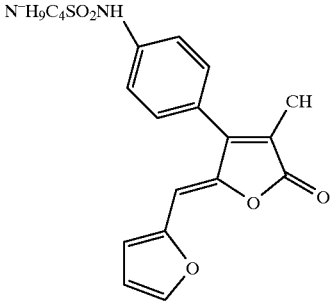
SD-0:
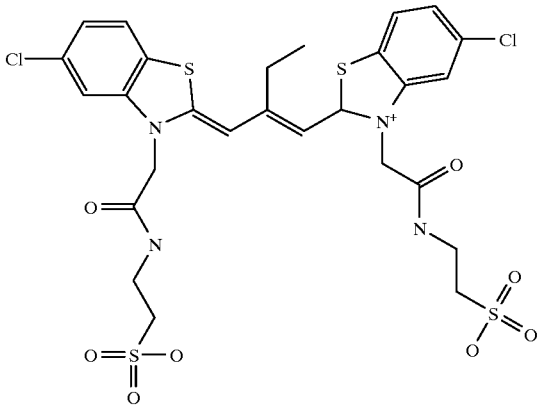

-continued
SD-1:
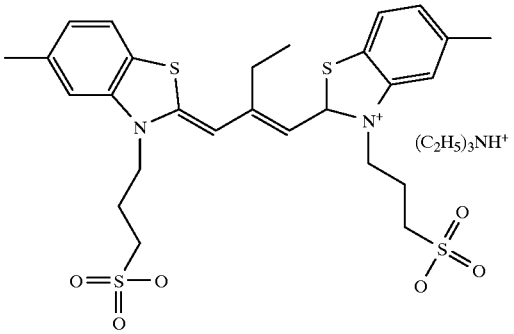
SD-2:
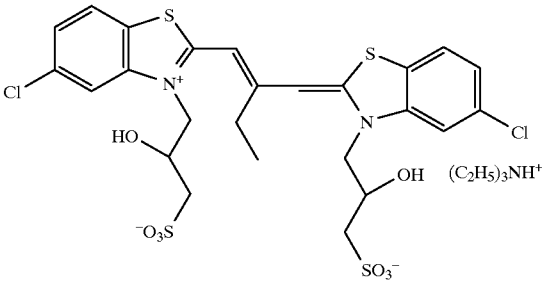
SD-3:
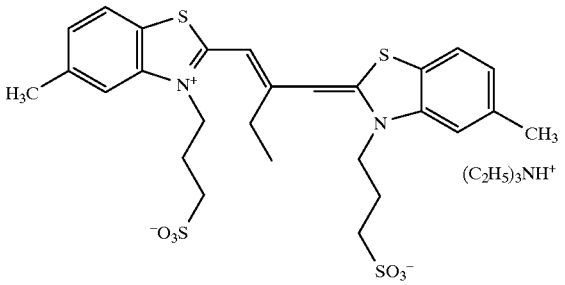
SD-4:
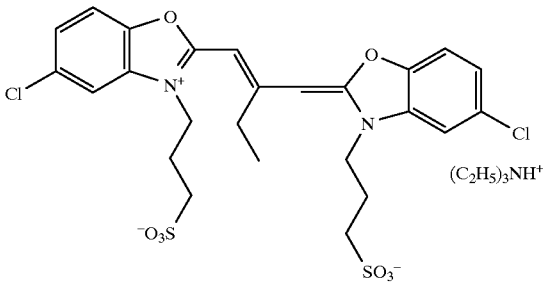
SD-5:
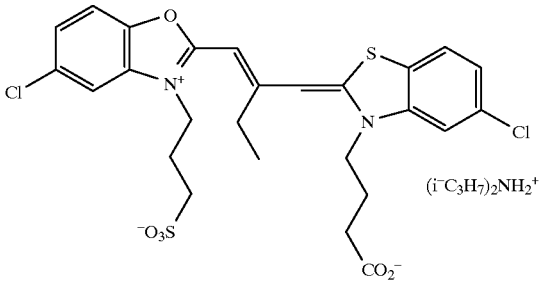

-continued
SD-6:
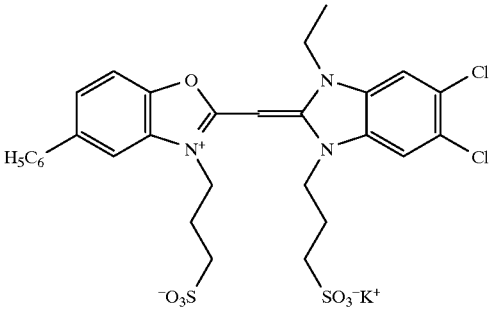
SD-7:
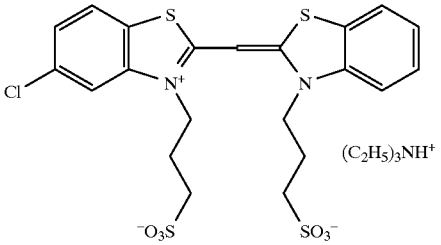
SD-8:
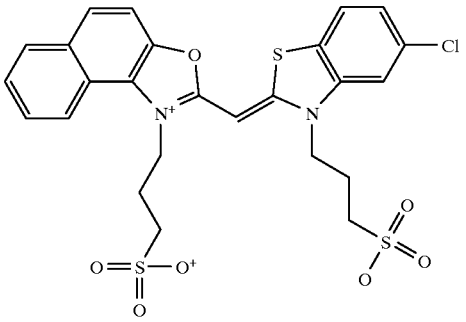
UV-1:
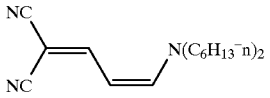
UV-4
Tinuvin 171 (Ciba Geigy)
I-1
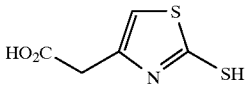

-continued

L-1:

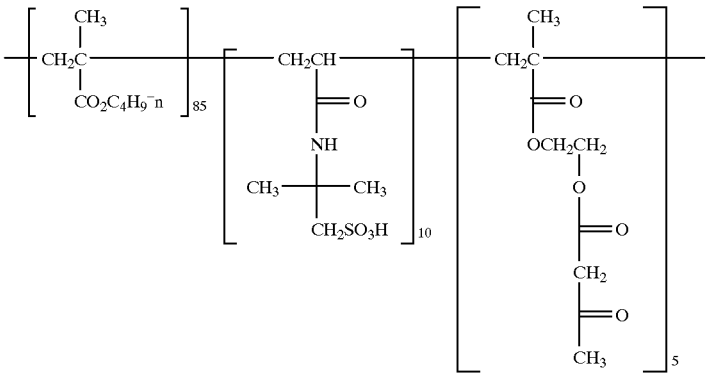

Hardener H-1:

1, 1'-[methylenebis(sulfonyl)]bis-ethene

Solvent S-1

1, 4-Cyclohexylenedimethylene bis(2-ethylhexanoate)

Solvent S-2

Phosphoric Acid, tris(methylphenyl) ester

Solvent S-3

1, 2-benzenedicarboxylic acid, dibutyl ester

While the invention has been described with particular reference to a preferred embodiment, it will be understood by those skilled in the art the various changes can be made and equivalents may be substituted for elements of the preferred embodiment without departing from the scope of the invention. In addition, many modifications may be made to adapt a particular situation in material to a teaching of the invention without departing from the essential teachings of the present invention.

We claim:

1. A photographic element capable of forming a reversal image comprising:

a support and, coated on said support, at least one image recording emulsion layer comprised of a dispersing medium and radiation sensitive silver salt grains and at least one substantially non-image forming intercoat or overcoating layer comprising:

a) a light sensitive silver halide imaging emulsion which is less than 10 percent of the mass of the total imaging emulsion in the element; and b) a non-image forming silver salt emulsion having a grain size less than 0.15 $\mu$m; wherein in the intercoat or overcoat layer the molar ratio of the grain population of the non-image forming emulsion to that of the light sensitive imaging emulsion is greater than 3:2 or the surface area ratio of the grains of the non-image forming emulsion to the grains of the light sensitive imaging emulsion is more than 2:1.

2. The element of claim 1 wherein the silver salt is a silver halide.

3. The element of claim 1 wherein in the intercoat or overcoat layer the molar ratio of the grain population of the non-image forming emulsion to that of the imaging emulsion is greater than 3:2 and the surface area ratio of the grains of the non-image forming emulsion to the grains of the imaging emulsion is more than 2:1.

4. The photographic element of claim 3 wherein in the intercoat or overcoat layer the molar ratio of the grain population of the non-image forming emulsion to that of the light-sensitive imaging emulsion is greater than 2:1 or the surface area ratio of the grains of the non-image forming emulsion to the grains of the light sensitive imaging emulsion is more than 3:1.

5. The photographic element of claim 3 wherein in the intercoat or overcoat layer the molar ratio of the grain population of the non-image forming emulsion to that of the light sensitive imaging emulsion is greater than 3:1 or the surface area ratio of the grains of the non-image forming emulsion to the grains of the light sensitive imaging emulsion is more than 4:1.

6. The photographic element of claim 1 wherein the intercoat or overcoat layer is an overcoat layer.

7. The photographic element of claim 6 wherein the overcoat layer is directly above the blue color record layer.

8. The photographic element of claim 6 additionally comprising an oxidized developer scavenger layer between the overcoat layer and the color record layer furthest from the support.

9. The photographic element of claim 8 wherein the imaging silver halide emulsion and the non-imaging forming emulsion are delivered to coating operation as separated melts.

10. The element of claim 1 wherein the intercoat or overcoat layer is an intercoat layer.

11. The photographic element of claim 1 wherein the layers between the support and the overcoat layer comprise red, blue and green color records.

12. The photographic element of claim 11 wherein the layers between the support and the overcoat layer comprise, in order, red, green and blue color records.

13. The photographic element of claim 11 wherein the imaging emulsion in the intercoat or overcoat layer is more blue light sensitive than red and green light sensitive.

14. The photographic element of claim 11 wherein the imaging emulsion in the intercoat or overcoat layer is more green light sensitive than blue and red light sensitive.

15. The photographic element of claim 11 wherein the imaging emulsion in the intercoat or overcoat layer is more red light sensitive than green and blue light sensitive.

16. The photographic element of claim 11 wherein the imaging emulsion in the intercoat or overcoat layer is sensitized to green and red light.

17. The photographic element of claim 1 wherein the intercoat or overcoat layer contains a coupler capable of forming image dye in the amount of less than 20% of the maximum image density in the element.

18. The photographic element of claim 1 wherein the non-image forming emulsion grain size is less than 0.07 $\mu$m.

19. The photographic element of claim 1 wherein the imaging emulsion in the intercoat or overcoat layer comprises tabular grain emulsions.

20. The photographic element of claim 1 wherein the mass of the light sensitive imaging emulsion in the intercoat or overcoat layer is less than 5 percent of the total mass of the imaging emulsions in the element.

21. The element of claim 1 wherein in the intercoat or overcoat layer the surface area ratio of the grains of the non-image forming emulsion to the grains of the imaging emulsion is more than 3:1.

22. The element of claim 1 wherein in the intercoat or overcoat layer the surface area ratio of the grains of the non-image forming emulsion to the grains of the imaging emulsion is more than 4:1.

23. A multicolor photographic element capable of forming a dye image comprising:

a support and, coated on said support, at least one image recording emulsion layer comprised of a dispersing medium and radiation sensitive silver halide grains and at least one substantially non-image forming overcoating layer comprising:

a) a red light or green light or blue light sensitive silver halide imaging emulsion which is less than 10 percent of the mass of the total imaging emulsion in the element; and b) a non-image forming silver halide emulsion having grain size less than 0.15 $\mu$m; wherein in the overcoat layer the molar ratio of the grain population of the non-image forming emulsion to that of the light-sensitive imaging emulsion is greater than 3:2 or the surface area ratio of the grains of the non-image forming emulsion to the grains of the light sensitive imaging emulsion is more than 2:1.

24. The element of claim 23 wherein in the overcoat layer the imaging emulsion comprises a most insoluble species and the grain population of the non-image forming emulsion is more soluble than the most insoluble species of the imaging emulsion, the molar ratio of the grain population of the non-image forming emulsion to that of the imaging emulsion is greater than 3:2 and the surface area ratio of the grains of the non-image forming emulsion to the grains of the imaging emulsion is more than 2:1.

25. The photographic element of claim 24 wherein the non-image forming emulsion grain size is less than 0.07 $\mu$m.

26. The photographic element of claim 23 wherein the layers between the support and the overcoat layer comprise red, blue and green color records.

27. The photographic element of claim 26 wherein the imaging emulsion in the overcoat layer is more blue light sensitive than red and green light sensitive.

28. The photographic element of claim 26 wherein the imaging emulsion in the overcoat layer is more green light sensitive than blue and red light sensitive.

29. The photographic element of claim 26 wherein the imaging emulsion in the overcoat layer is more red light sensitive than blue and green light sensitive.

30. The photographic element of claim 26 wherein the imaging emulsion in the overcoat layer is sensitized to green and red light.

31. The photographic element of claim 23 wherein the layers between the support and the overcoat layer comprise, in order, red, green and blue color records.

32. The photographic element of claim 31 wherein the overcoat layer is directly above the blue color record layer.

33. The photographic element of claim 23 wherein the overcoat layer contains a coupler capable of forming image dye in the amount of less than 20% of the maximum image density in the element.

34. The photographic element of claim 21 additionally comprising an oxidized developer scavenger layer between the overcoat layer and the color record layer furthest from the support.

* * * * *